US006833162B2

(12) United States Patent
Chattopadhyay et al.

(10) Patent No.: US 6,833,162 B2
(45) Date of Patent: Dec. 21, 2004

(54) COLORED NANOLITHOGRAPHY ON GLASS AND PLASTIC SUBSTRATES

(75) Inventors: Arun Chattopadhyay, Guwahati (IN); Anumita Paul, Guwahati (IN); Devasish Chowdhury, Guwahati (IN)

(73) Assignee: Council of Scientific and Industrial Research, New Delhi (IN)

( * ) Notice: Subject to any disclaimer, the term of this patent is extended or adjusted under 35 U.S.C. 154(b) by 174 days.

(21) Appl. No.: 10/305,037

(22) Filed: Nov. 26, 2002

(65) Prior Publication Data

US 2004/0101616 A1 May 27, 2004

(51) Int. Cl.[7] ..... B05D 3/12; B05D 5/06

(52) U.S. Cl. ..... 427/273; 427/277; 427/287; 427/335; 427/369; 264/293

(58) Field of Search ..... 427/264, 269, 427/270, 273, 277, 287, 335, 369; 264/293, 298, 313

(56) References Cited

U.S. PATENT DOCUMENTS 6,517,995 B1 * 2/2003 Jacobson et al. ..... 430/320
6,544,634 B1 * 4/2003 Abrams et al. ..... 428/212

* cited by examiner

*Primary Examiner*—Fred J. Parker
(74) *Attorney, Agent, or Firm*—Schiff Hardin LLP

(57) ABSTRACT

A process for generating colored nanolithography patterns of parallel lines or cross pattern lines on a glass or plastic substrate, said process consisting the steps of pressing a polycarbonate or aluminium mold obtained from a compact disk on a glass or plastic surface inked with a permanent marker ink for one or more times to create lithographic patterns of parallel colored lines or cross pattern lines. Also, the present invention provides a method for generating colored nanolithography patterns of parallel lines or cross pattern lines on a glass or plastic substrate having dried ink, said process consisting keeping the plastic or glass substrate having the dried ink in a chamber containg ethanol or toluene for about 10 seconds followed by pressing the polycarbonate or aluminium mold obtained from a compact disk on the glass or plastic surface to generate the pattern.

9 Claims, 3 Drawing Sheets

A schematic diagram to represent the method of imprinting patterns

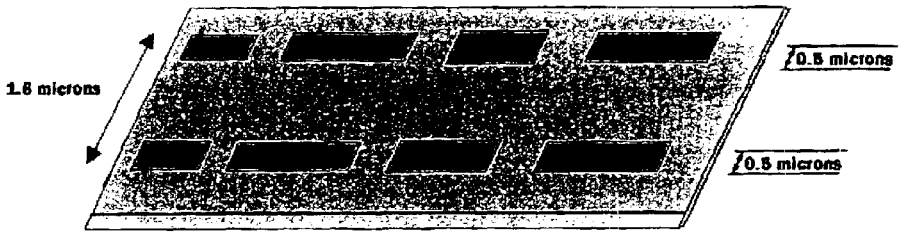
Figure 1 : Diagram depicting the spiral track and separation between two lines.
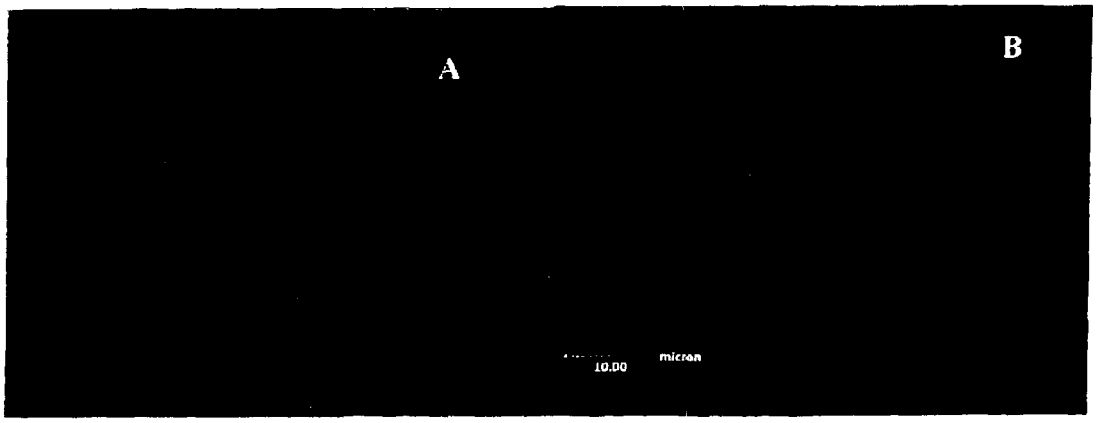
Figure 2 : Optical micrographs of (A) Polycarbonate disk (B) Aluminium foil of compact disk that was used as mold.

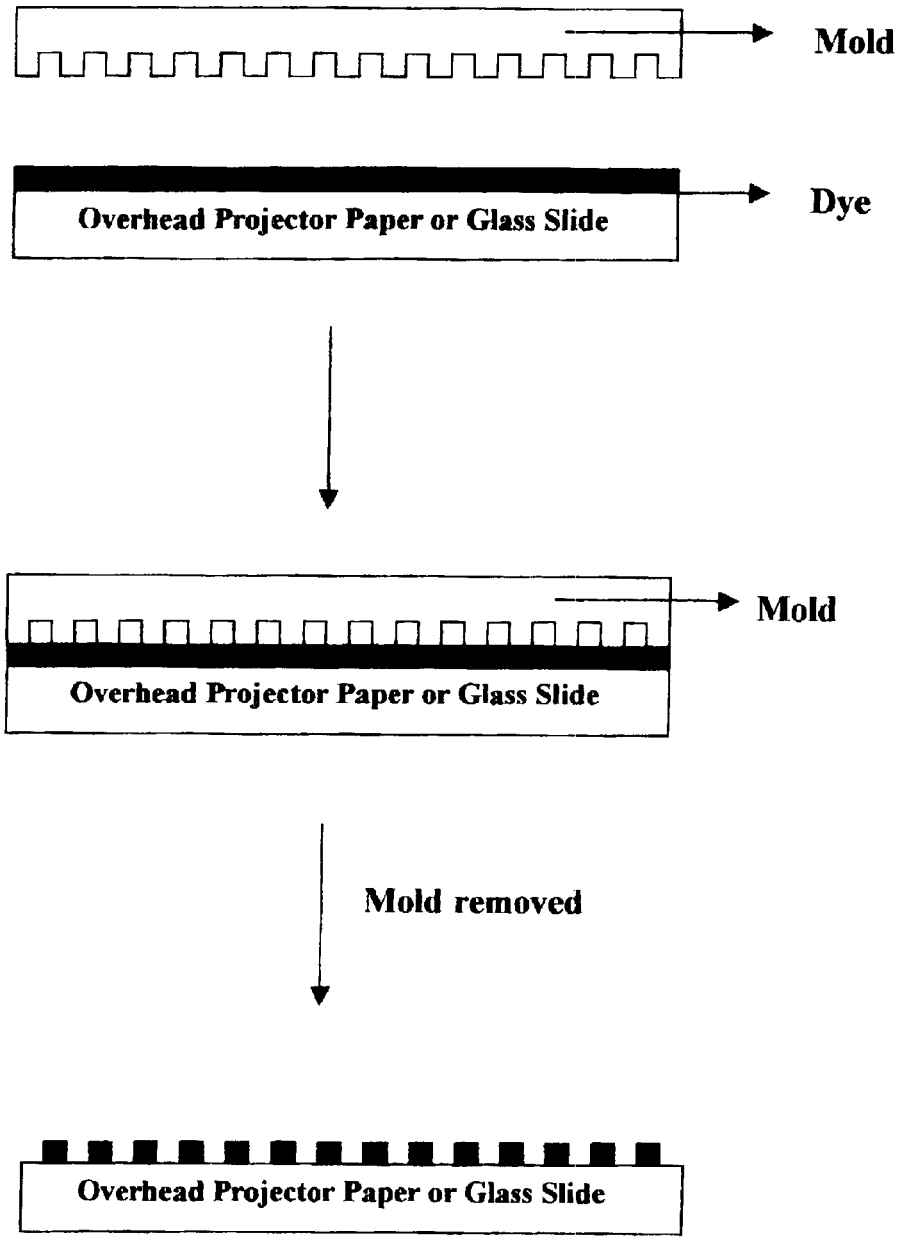
Figure 3 : A schematic diagram to represent the method of imprinting patterns

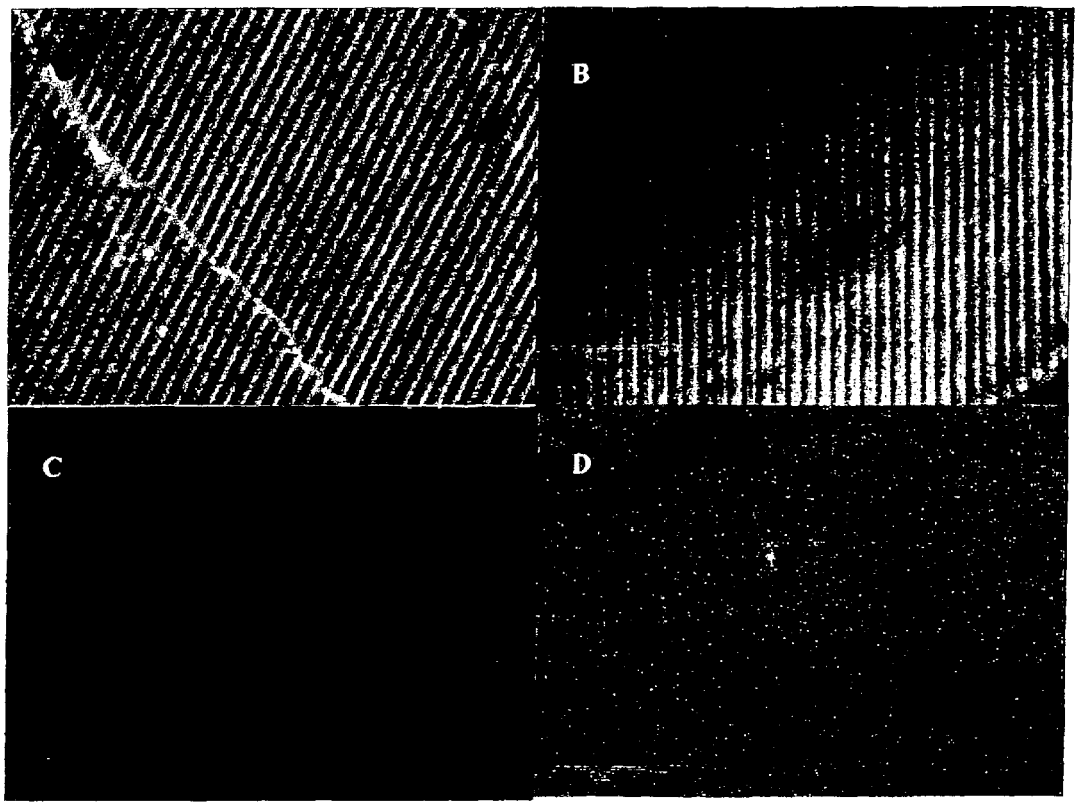
Figure 4 : (A-C)Optical micrographs of patterns obtained using polycarbonate or aluminnium foil as mold on glass and OHP with different permanent coloured marker dyes, (D) Cross pattern generated by pressing the mold perpendicular to initial imprints.
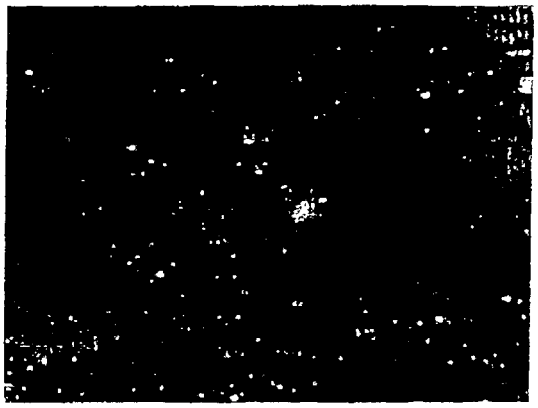
Figure 5: Optical micrograph of pattern generated by making the ink wet by keeping it in ethanol chamber

COLORED NANOLITHOGRAPHY ON GLASS AND PLASTIC SUBSTRATES

FIELD OF THE INVENTION

The present invention relates to Colored Nanolithography on glass and plastic substrates. Particularly, the present invention relates to a simple, versatile and inexpensive method of generating submicron-scale color pattern on various surfaces such as overhead projector paper (OHP) and glass. More particularly, the present invention relates to method for generating colored parallel lines with submicron scale spacing between each other and microarrays of ink spots positioned at predetermined angles and spacing. The method of the present invention has enormous application potential in information storage, in storing hidden information in currency notes, in sensors, and in so called "E-paper" for displays. The use of flexible plastic material like OHP paper enhances the possibility of storing designs in foldable substrates.

BACKGROUND AND PRIOR ART DESCRIPTION

Generating fast, easy, inexpensive, high resolution two and three dimensional patterned structures on solid surfaces has been a challenge leading to the discovery of a number of methods for imprinting patterns in addition to photolithography. Important among them are soft lithography and micropen lithography. In soft lithography, different micromolding techniques are used to generate structures at multiple length scales and dimensions using a variety of substrates and imprint materials. Molecular self-assembly has helped improve the resolution of structures further. All these methods are guided by applications such as microreactors, sensors, microelectromechanical systems, electronic devices at micro and nano scales.

Reference can be made to Xia, Y Whitesides, G. M. *Angew, Chem. Int. Ed.* 1998,37,550 wherein soft lithographic methods were discussed. Reference of micropen lithography can be found in Fan, H.; Lu, Y.; Stump, A.; Reed, S. T.; Baer, T.; Schunk, R.; Perez-Luna, V.; Lopez, G. P., Brinker, C. J. *Nature* 2000, 405, 56. However, none of the above methods has emphasized the generation of colored pattern that has enormous application potential in information storage, sensors, the so-called "E-paper" for displays. Storage of information in "true" colors is expected to shorten the processing time for retrieval of information considerably. Also, imprinting of patterns on flexible plastic materials might enhance the versatility towards material application. Although, ink-jet printing has been used to obtain organic light emitting devices of doped polymers, there have been no reports of generating patterns on color at the submicron scale.

The drawback of the present method of nanolithography by using a stamp is that it employs only non-colored stamping of materials on different substrates. Thus there is no example of colored nanolithography in the form of stamping otherwise known as soft lithography in the literature. The fundamental drawback of the present method is that there is no scope of storing colored information (image) in this method. Thus storage and retrieval of colored information (picture etc.) is either not possible or not specified at all. Indeed there is a need for new methods of generation of colored nanolithography that will be useful for storing colored information, sensors, catalysts etc, In addition, there is no example of stamping with nanometer resolution on plastic substrates. This is important as one could store information in the form of electronic materials made of plastic substrates. There is a need to have colored nanolithographic patterns on plastic substrates and glass.

OBJECTS OF THE INVENTION

The main object of the present invention is to provide Colored Nanolithography on glass and plastic substrate, which obviates the drawbacks as, detailed above.

SUMMARY OF THE INVENTION

The present invention provides for the first time a method for nanolithography in colour using the principle of soft lithography. As demonstration of the present method, the Inventors have used permanent marker pen ink of various colors as the "ink" and components of commercially available compact disk as the mold (stamp) to store information.

BRIEF DESCRIPTION OF THE ACCOMPANYING DRAWINGS

In the drawing(s) accompanying this specification,

FIG. 1 represents diagram depicting the spiral track and separation between two lines on a commercially available compact disk.

FIG. 2(A) represents Optical micrographs of Polycarbonate disk and FIG. 2(B) represents Optical micrographs of Aluminium foil of the compact disk that is used as mold in the present invention.

FIG. 3 represents a schematic diagram representing the method for generating submicron-scale color pattern on a plastic substrate or glass.

FIGS. 4(A–C) represents optical micrographs of parallel patterns obtained using polycarbonate or aluminium foil as mold on glass and OHP with different permanent colored marker dyes, while FIG. 4(D) represents optical micrographs of cross patterns generated by pressing the mold perpendicular to initial imprints.

FIG. 5 represents optical micrograph of pattern generated by making the ink wet by keeping it in ethanol chamber.

DETAILED DESCRIPTION OF THE PRESENT INVENTION

Accordingly, the present invention provides a process for generating colored nanolithography patterns of parallel lines or cross pattern lines on a glass or plastic substrate, said process consisting the steps of pressing a polycarbonate or aluminium mold obtained from a compact disk on a previously inked glass or plastic surface for one or more times to create lithographic patterns of parallel coloured lines or cross pattern lines.

More particularly, the present invention provides a process for generating colored nanolithography patterns of parallel lines or cross pattern lines on a glass or plastic substrate, said process consisting the steps of:

(a) inking the glass or plastic substrate using a permanent marker ink;

(b) allowing the ink to get semi-dried by keeping the substrate in air for about 30 to 90 seconds;

(c) pressing a polycarbonate or aluminium mold obtained from a compact disk on the semi-dried inked glass or plastic substrate for one or more times, and (d) drying the glass or plastic substrate.

In an embodiment of the present invention, the polycarbonate or aluminium mold is pressed at predetermined angle to create cross pattern lines on the glass or plastic substrate.

In another embodiment of the present invention, the substrate is inked using permanent marker ink.

In yet another embodiment of the present invention, the polycarbonate or aluminium mould is pressed on the inked surface after the inked surface has dried for about 1 minute in air.

In still another embodiment of the present invention, the polycarbonate or aluminum mould is pressed on the glass or plastic substrate either manually or using a pressing machine.

In one more embodiment of the present invention, the polycarbonate or aluminium mould is pressed on the glass or plastic substrate for at least 5 seconds to impart the pattern of parallel lines or cross pattern lines.

In a one another embodiment of the present invention, the plastic substrate is an overhead projector (OHP) sheet.

The present invention introduces a simple, versatile and inexpensive method of generating submicron-scale color patterns on various surfaces. Permanent marker pens of various colors are used to write on overhead projector (OHP) paper. The molds used were the polycarbonate disk and aluminum foil line patterns in an ordinary compact disc (CD). A line mark was made with the help of an OHP pen on the OHP paper and then the mold was placed on the mark after about a minute, finger pressed before the ink had completely dried. The Inventors have used marker pens with various colors of ink for generating patterns of various colors. The same procedure was used for generating pattern on a glass slide.

A compact disk is typically made of polycarbonate plastic, about 1.2 mm thick. Patterns are drilled in the form of a single spiral track on polycarbonate disk. This gives rise to microscopic bumps on polycarbonate disk. A thin, reflective aluminum layer is sputtered onto the disk covering the bumps. Then a thin acrylic layer is sprayed over the aluminum to protect it. The typical width and depth of each line in the spiral track on polycarbonate disk is 0.8 and 0.5 $\mu$m respectively, and separation between two such lines is about, 6 $\mu$m (FIG. 1). As the diameter of a typical CD is much larger than the separation between two lines, under an optical microscope the lines appear parallel with nearly infinite radii of curvatures. The aluminum coating on the polycarbonate membrane also has the structural patterns that appear as parallel lines under an optical microscope. The polycarbonate disk and the aluminum foil are separated and are independently used as molds for generating two-dimensional pattern. For experiments the Inventors have used parts of both the aluminum foil and the polycarbonate disk to imprint patterns. Optical micrographs of patterns found in polycarbonate disk and aluminum foil in a CD are shown in FIG. 2. It is clear from the optical micrographs that even after the CD is dismantled, the original lines remain intact and hence could be used as molds. It may be mentioned here that there are in general two kinds of CD available in the market. The first one is a permanent CD and has a pattern shown in FIG. 1. While the second one is a recordable CD and does not contain bumps but has continuous lines as shown in-FIG. 2. The Inventors have used a recordable CD in the examples of the present invention. However, a person of ordinary skill in the art can also use a pre-recorded CD having pattern as shown in FIG. 1 to generate pattern on the plastic or glass substrate.

A schematic view of the present method of imprinting patterns on various surfaces is shown in FIG. 3. Ordinary lines drawn using blue, green, and red permanent marker pens on OHP paper or glass surface and optical micrographs of each of them after imprints of pattern from molds are shown in FIGS. 4(A–C). The colors in the micrographs are true colors of the imprints. As clear from the figures, just pressing the disk onto the ink could draw distinct parallel lines of submicron scale. Similar procedure can be adopted while using aluminium foil as a mold. Cross-patterns can also be generated on glass by a polycarbonate mold. In each case, at first the marker pen drew a single line on a glass slide. The polycarbonate mold was then pressed onto the line to make parallel microlines as before. The mold was then placed on the line at an angle different from the first position and then pressed. The result was the production of a microarray of ink dots positioned at angles determined by the relative angles of positioning of the molds. Arrays, shown in FIG. 4(D), were generated by positioning the mold perpendicular with respect to initial imprints.

The Inventors were also successful in generating patterns on already dried inked surfaces. The same has been achieved by making the ink wet by keeping the surface in an ethanol chamber. A substrate having overnight dried permanent ink mark (for example a line) was kept in an ethanol or toluene chamber for about 10 seconds. The ethanol chamber was made of a beaker with a cap containing about 5 ml of ethanol soaked with ordinary filter paper for about two hours prior to use. After about 10 seconds, the substrate is removed from the ethanol or toluene chamber and the polycarbonate or alluminium mould was pressed on the inked surface to impart the nanolithographic pattern. The surface was dried to obtain the colored nanolithographic image. FIG. 5 shows the optical micrograph obtained by following the aforesaid procedure.

The resolution of the patterned lines could be increased using a mold with lines and patterns of higher resolution. The same principle could be used for imprinting designed arrays of various materials on plastic and glass substrates in accordance with their use.

The main advantages of the present invention are:

1. Introduction of the concept of nanolithography in colour using the principle of soft lithography.
2. The use of flexible plastic material like OHP paper enhances the possibility of storing designs in foldable substrates.
3. Storage of information in "true" colors may help shorten the processing time for retrieval of information considerably.
4. Manufacturing of arrays of colored materials for applications in sensors, displays etc.

We claim:

1. A process for generating colored nanolithography patterns of parallel lines or cross pattern lines on a glass or plastic substrate, said process consisting of the step of pressing a polycarbonate or aluminium mold obtained from a compact disk on a glass or plastic surface inked with a permanent ink for one or more times to create lithographic patterns of parallel coloured lines or cross pattern lines.

2. A process as claimed in claim 1, wherein the polycarbonate or aluminium mold is pressed at a predetermined angle to create cross pattern lines on the glass or plastic substrate.

3. A process as claimed in claim 1, wherein the substrate is inked using permanent marker ink.

4. A process as claimed in claim 1, wherein the polycarbonate or aluminium mould is pressed on the inked surface after the inked surface has dried for about 1 minute in air.

5. A process as claimed in claim 1, wherein the polycarbonate or aluminium mould is pressed on the glass or plastic substrate either manually or using a pressing machine.

6. A process as claimed in claim 1, wherein the polycarbonate or aluminium mould is pressed on the glass or plastic substrate for at least 5 seconds to patterns of parallel lines or cross pattern lines.

7. A process as claimed in claim 1, wherein the plastic substrate is an overhead projector (OHP) sheet.

8. A process for generating colored nanolithography patterns of parallel lines or cross pattern lines on a glass or plastic substrate, said process consisting of the steps of:

(a) inking the glass or plastic substrate using a permanent marker ink;

(b) allowing the ink to get semi-dried by keeping the substrate in air for about 30 to 90 seconds;

(c) pressing a polycarbonate or aluminium mold obtained from a compact disk on the semi-dried inked glass or plastic substrate for one or more times, and (d) drying the glass or plastic substrate.

9. A process for generating colored nanolithography patterns of parallel lines or cross pattern lines on a glass or plastic substrate containing dried ink, said process consisting of the steps of keeping the plastic or glass substrate having the dried ink in a chamber containg ethanol or toluene for about 10 seconds to make the ink wet and pressing a polycarbonate or aluminium mold obtained from a compact disk on the wet inked glass or plastic surface for one or more times to create lithographic patterns of parallel coloured lines or cross pattern lines.

* * * * *